United States Patent [19]

Keller et al.

[11] 4,415,008

[45] Nov. 15, 1983

[54] DEVICE FOR MONITORING THE WEFT THREAD TRAVEL ON AN AIR JET WEAVING MACHINE

[75] Inventors: Hans-Peter Keller, Oberdürnten; Max Bossard, Dürnten, both of Switzerland

[73] Assignee: Loepfe Brothers Limited, Wetzikon, Switzerland

[21] Appl. No.: 301,652

[22] Filed: Sep. 14, 1981

[30] Foreign Application Priority Data

Oct. 14, 1980 [CH] Switzerland ..... 7648/80

[51] Int. Cl.[3] ..... D03D 51/34

[52] U.S. Cl. ..... 139/370.2; 139/435; 250/561; 250/571; 340/677

[58] Field of Search ..... 139/370.2, 370.1, 435, 139/1 R, 450; 340/677; 250/559, 561, 571

[56] References Cited

U.S. PATENT DOCUMENTS

| | | | |
|---|---|---|---|
| 3,633,706 | 1/1972 | Kennedy | 139/1 R |
| 3,908,710 | 9/1975 | Van Mullekom | 139/370.2 X |
| 4,178,971 | 12/1979 | Malasek et al. | 139/435 |
| 4,215,728 | 8/1980 | Weidman et al. | 139/370.2 |

FOREIGN PATENT DOCUMENTS

| | | | |
|---|---|---|---|
| 367191 | 3/1973 | U.S.S.R. | 139/370.2 |
| 672241 | 7/1979 | U.S.S.R. | 139/370.2 |
| 757615 | 8/1980 | U.S.S.R. | 139/370.2 |

*Primary Examiner*—James Kee Chi

*Attorney, Agent, or Firm*—Werner W. Kleeman

[57] ABSTRACT

An electronic device for monitoring the insertion or travel of the filling or weft thread on an air jet weaving machine or loom which comprises at least one air jet arranged at the picking side of the machine, and a lathe or sley beam with thereon fixed lamellae forming a reed. The device comprises a tactile weft thread travel sensor arranged at the weaving machine upstream of said air jet, a start pulse generator controlled by the weaving machine, an optoelectrical sensor located near the end of the reed adjacent the weft receiving means, and electronic circuitry controlled by said start pulse generator and optoelectrical sensor for producing an activating signal defining the time interval during which the weft thread travel is monitored.

6 Claims, 3 Drawing Figures

DEVICE FOR MONITORING THE WEFT THREAD TRAVEL ON AN AIR JET WEAVING MACHINE

BACKGROUND OF THE INVENTION

The present invention relates to a new and improved device for monitoring the weft thread travel on an air jet weaving machine which is provided with a lathe or sley beam and a reed fixed thereon, an air jet for inserting the weft thread, and weft thread receiving means comprising suction means, said device comprising an optoelectrical weft thread sensor including a measuring area or field and being arranged at the reed such that the measuring area is crossed by the path of the weft thread travel.

In United Kingdom Pat. No. 1,432,422 there is disclosed a monitoring device of the aforementioned type comprising an optoelectrical sensor which is not designed for surveying the yarn travel, however responds, prior to the commencement of the read beat-up, when the foremost or leading free end of the filling or weft thread being inserted into the weaving shed crosses the measuring area or field of the sensor. Here, the criterion of a correct filling insertion is the signal difference produced by the weft thread entering the sensor. Thus, the presence of the weft thread rather than the weft travel is detected.

Operational experience has shown that thread presence monitoring is susceptible to trouble. In particular, false signals may be generated e.g. by fibre fly, thus simulating correct filling insertion when the weft thread is absent, and preventing the loom from being stopped.

SUMMARY OF THE INVENTION

It is a primary object of the present invention to provide an improved electronic weft thread travel monitor ensuring safer and more reliable monitoring of the filling or weft thread insertion on an air jet weaving machine.

It is a further significant object of the present invention to provide for a safer and more positive surveyance of the filling insertion by using an additional tactile, in particular a triboelectrical thread travel sensor.

It is another more specific object of the present invention to avoid false or spurious sensing signals by protecting the thread travel sensor from sound produced by the main air jet or air jets of the weaving machine.

These objects and others which will become more readily apparent as the description proceeds, are realized by the inventive monitoring device which comprises a tactile weft travel sensor arranged at the weaving machine upstream of the air jet and a start pulse generator controlled by the weaving machine. The optoelectrical sensor is located near the end of the reed adjacent the weft receiving means. Electronic circuitry is provided which is controlled by the start pulse generator and optoelectrical sensor for producing an activating signal defining the time interval during which the weft thread travel is monitored.

BRIEF DESCRIPTION OF THE DRAWINGS

The invention will be better understood and objects other than those set forth above will become apparent upon consideration of the following detailed description thereof which refers to the annexed drawings wherein.

DETAILED DESCRIPTION OF THE PREFERRED EMBODIMENTS

Figure 1:
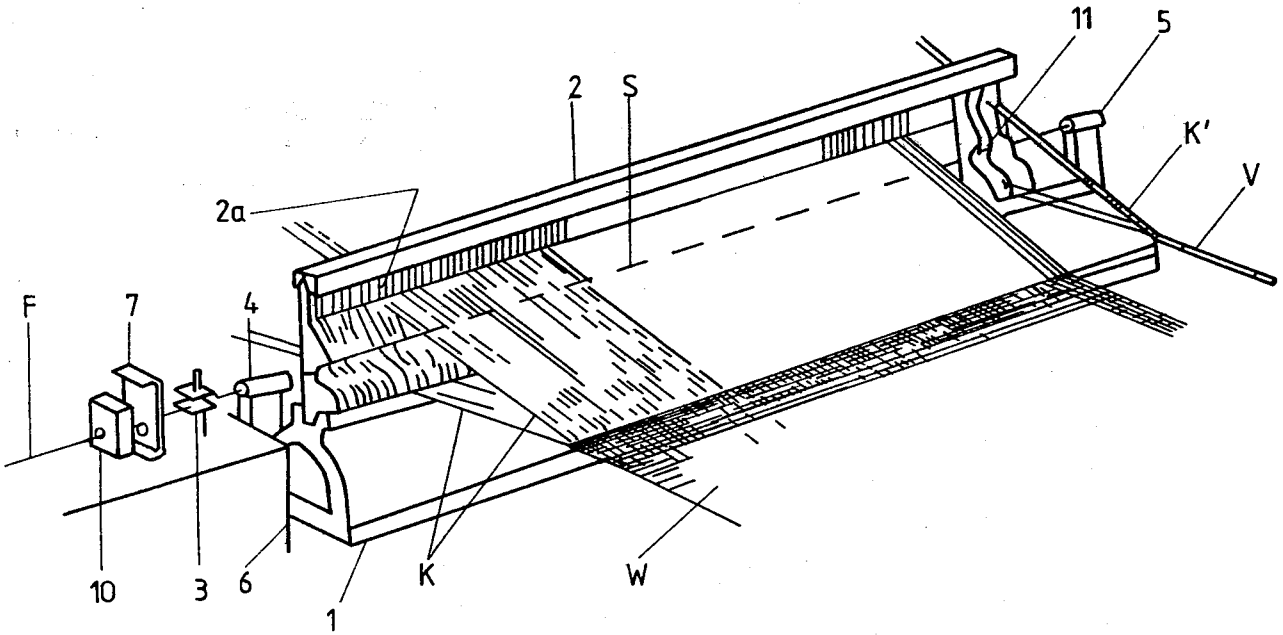
FIG. 1 shows, in perspective and schematic representation, the sley or lathe beam and reed of an air jet weaving machine or loom provided with two sensors of the inventive weft thread monitor.

Describing now the drawings, and with particular reference to FIG. 1, the reed 2 is attached to the lathe or sley beam 1 of the weaving machine. The warp threads K form the shed into which the filling or weft thread F is inserted. The warp threads K do not extend over the entire width of the reed 2 such as to leave the left and right ends thereof free. At the outermost right end of the reed there are shown some further warp threads K′ forming a lost selvedge V. The path of the weft travel in the shed is marked by the dashed line S.

On the frame 6 of the machine there are mounted at the left or picking side a thread brake 3 and an air jet 4, and at the right or catching side there is arranged a suction pipe or tube 5. The weft thread F is propelled into the shed by an air stream emanating from the air jet 4. The suction pipe 5 receives the foremost or leading end of the inserted weft thread and keeps the same tensioned by a sucking air flow.

It is to be understood that the inventive monitoring device may also be mounted on looms where additional or auxiliary air jets are provided along the lathe or sley beam of the loom.

On the picking side and upstream of the thread brake 3 there is arranged a tactile sensor 10, that is one which responds to a travelling and contacting thread, e.g. a piezoelectrical or triboelectrical sensing device. On the receiving or catching side and in the gap formed between the warp threads K and K′, an optoelectrical sensor 11 is mounted between lathe or sley beam 1 and reed 2. By way of example, the tactile sensor 10 may be constructed in a manner as shown and described in Swiss Pat. No. 583,656. When the weft thread is being inserted, the tactile sensor 10 produces a thread travel signal as schematically shown at 10A in FIG. 3, that is an irregular A.C. signal or noise signal.

The optoelectrical sensor 11 is accommodated to the shape of the lamellae 2*a* of the reed 2 such that the filling or weft thread which is in the process of being inserted into the shed crosses the measuring area or field of the sensor 11 and produces a single signal pulse. This signal pulse or a stop pulse derived therefrom defines the end of an activating interval during which the weft thread travel is monitored by the tactile sensor 10. Suitable optoelectrical sensors are described e.g. in the above mentioned United Kingdom Pat. No. 1,432,422.

Figure 2:
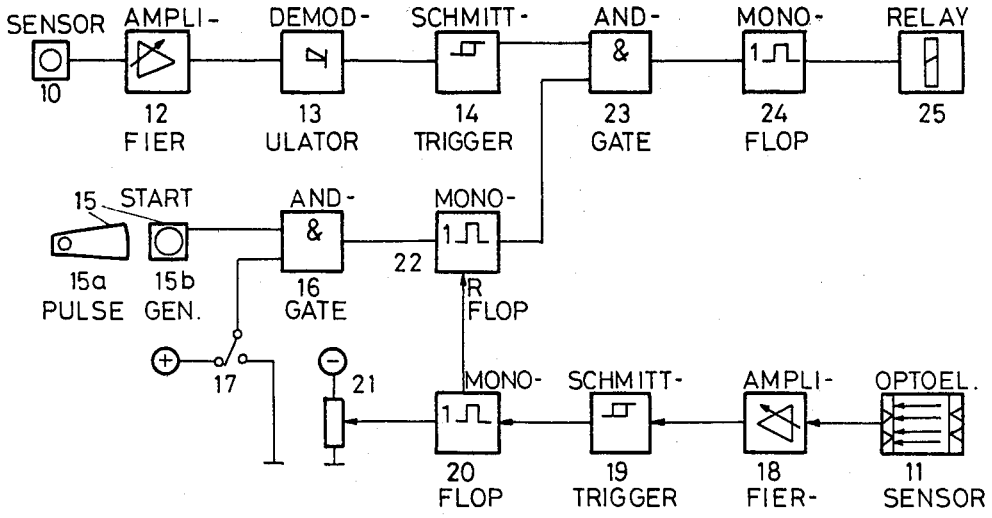
FIG. 2 is a block schematic of the electronic circuitry of the weft thread monitor.

The start of this activating interval is defined in usual manner by a start pulse generator 15. A suitable start pulse generator 15 is schematically illustrated in FIG. 2 and comprises, by way of example, a magnetic vane 15*a* attached to the main drive shaft of the loom, and a magnetic sensor 15*b* fixedly mounted at the frame 6. When the magnetic vane 15*a* passes by the sensor 15*b*, a start pulse, as shown at 15A in FIG. 3, is produced.

With reference to FIG. 2, a series connection of an A.C. amplifier 12, a demodulator 13 and a Schmitt-trigger 14 is connected to the tactile or triboelectrical sensing device 10. By these switching circuits 12 through 14 the thread travel signal 10A, FIG. 3, is amplified, rectified and smoothed such as to furnish a negative going well-defined thread travel pulse 14A.

The magnetic sensor **15*b* is connected to a first input of an AND-gate 16 whose second input is a positive voltage supplied through a change-over switch 17. The start pulse 15A from sensor 15*b* is conducted through the AND-gate 16 to a signal input of a monoflop 22 having a reset terminal R. As long as no reset signal exists at reset terminal R, the monoflop 22 produces an output pulse of a predetermined duration, e.g. in the range from 100 to 300 milliseconds, which duration is to be accommodated to the width of the reed 2. The monitoring device shown in FIG. 2 may be deactivated, for testing purposes, by connecting the second input of the AND-gate 16 to ground, by means of the change-over switch 17**.

Figure 3:
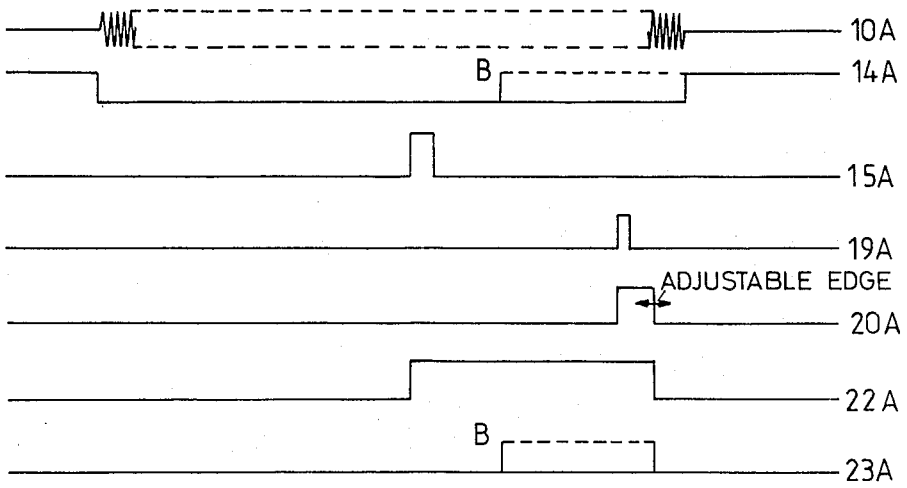
FIG. 3 is a diagram of the signal forms generated by the circuits shown in FIG. 2, as far as they serve for understanding the invention.

The optoelectrical sensor 11 and the serially thereto connected circuits 18 through 20 serve for producing a reset pulse 20A, FIG. 3, which indicates a correct weft thread insertion. The reset pulse causes termination of the output pulse of monoflop 22 prior to the predetermined duration thereof. When no such rest pulse 20A occurs within the predetermined duration of the output of monoflop 22 indicating failure of the weft thread, the weaving machine is stopped.

When the weft thread is correctly inserted, a signal pulse is furnished by the optoelectrical sensor 11. This signal pulse is amplified in the variable gain amplifier 18, and transformed into a rectangular stop pulse 19A in a pulse shaper 19, e.g. a Schmitt-trigger. The leading edge of the stop pulse 19A triggers the monoflop 20 which produces an extended or prolonged stop pulse 20A. The trailing edge of this extended stop pulse 20A may be adjusted, by means of a potentiometer 21, as indicated by the double arrow at 20A in FIG. 3.

The trailing edge of the stop pulse 20A causes, through reset terminal R, the monoflop 22 to be reset: as a result the latter produces an activating pulse 22A which when adequately adjusted covers the last phase of the weft insertion and thus warrants a safe monitoring of this phase.

The AND-gate 23 compares the thread travel pulse 14A with the activating pulse 22A. The AND-gate 23 furnishes no output signal when—within the interval of the activating pulse 22A the thread travel pulse 14A has the value of logic zero, i.e. when the weft thread is correctly inserted. This is shown by the continuous horizontal line at 23A, FIG. 3. In this event, the weaving machine continues to operate. However, when the thread travel pulse is missing or ends prematurely, as indicated at B in the signal 14A, FIG. 3, the AND-gate 23 produces a stop signal as shown by the dashed line at 23A, FIG. 3, causing the loom to be stopped. A monoflop 24 is connected to the output of AND-gate 23. The monoflop 24 is triggered by the leading edge of a switch-off signal 23A and furnishes a switch-off pulse of fixed duration, e.g. 100 milliseconds activating a relay 25 which causes the loom to be stopped.

As mentioned above, sensor 10 may be designed as a triboelectrical sensing device which is advantageous since it is largely insensitive to noise, i.e. mechanical vibrations produced by the loom, and particularly sound produced by the air jet 4. Frequently there are used tactile piezoelectrical sensing devices; however, these devices sensitively respond to mechanical vibrations and sound transmitted by air and thus may produce false or spurious signals. Generally, it is advantageous—in particular when piezoelectrical sensors are used—to provide special measures for suppressing the effect of such noise upon the sensing device. For this purpose, there is provided a sound absorbing shield 7 against the sensor 10 and facing the air jet 4 in the embodiment shown in FIG. 1.

While there is shown and described a present preferred embodiment of the invention, it is to be distinctly understood that the invention is not limited thereto, but may be otherwise variously embodied and practiced within the scope of the following claims. Accordingly,

What we claim is:

1. In a device for monitoring the weft thread travel on an air jet weaving machine which is provided with a lathe beam and a reed fixed thereon, an air jet for inserting the weft thread, and weft thread receiving means comprising suction means, said device comprising an optoelectrical weft thread sensor including a measuring area and arranged at the reed such that the measuring area is crossed by the path of the weft thread travel, the improvement which comprises:

a tactile weft thread travel sensor arranged at the machine upstream of the air jet;

a start pulse generator controlled by the weaving machine;

the optoelectrical sensor being located near the end of the reed adjacent the weft receiving means; and electronic circuitry controlled by said start pulse generator and optoelectrical sensor for producing an activating signal defining the time interval during which the weft thread travel is monitored.

2. The device as defined in claim 1, wherein:

the tactile weft thread travel sensor comprises a triboelectrical sensor.

3. The device as defined in claim 1 or 2, wherein:

a sound absorbing shield is located between the air jet and the tactile weft thread travel sensor.

4. The device as defined in claim 1, wherein:

said electronic circuitry comprises a monoflop connected in circuit with said start pulse generator and serving to produce an output pulse of a predetermined duration; and said electronic circuitry further comprising circuit means operatively connected in circuit with said monoflop and serving to produce a reset pulse indicative of correct weft thread insertion, said reset pulse initiating termination of an output pulse of said monoflop prior to said predetermined duration thereof.

5. The device as defined in claim 4, wherein:

said circuit means fails to produce a reset pulse within said predetermined duration upon failure of the insertion of the weft thread.

6. The device as defined in claim 4, wherein:

said electronic circuitry further comprises additional circuit means operatively connected in circuit with said tactile weft thread travel sensor for receiving therefrom a thread travel pulse; and said additional circuit means being operatively connected with said monoflop for receiving an activating pulse therefrom when said monoflop is reset by said reset pulse.

* * * * *